United States Patent [19]

Cowell et al.

[11] 4,360,151

[45] Nov. 23, 1982

[54] AEROSOL RESISTANT BOWL ROTOR

[75] Inventors: Mark J. Cowell, Mountain View; Thomas D. Sharples, Atherton, both of Calif.

[73] Assignee: Beckman Instruments, Inc., Fullerton, Calif.

[21] Appl. No.: 164,877

[22] Filed: Jul. 1, 1980

[51] Int. Cl.[3] ..... B04B 7/02

[52] U.S. Cl. ..... 233/27; 233/1 B

[58] Field of Search ..... 233/26, 27, 1 R, 1 A, 233/28, 1 B

[56] References Cited

U.S. PATENT DOCUMENTS

| | | | |
|---|---|---|---|
| 2,885,145 | 5/1959 | Danielsson | 233/26 |
| 3,028,075 | 4/1962 | Blum | 233/26 |
| 3,133,882 | 5/1964 | Mitchell | 233/26 |
| 4,010,890 | 3/1977 | Wright | 233/26 |
| 4,202,487 | 4/1980 | Edwards | 233/1 A |

*Primary Examiner*—Robert W. Jenkins

*Attorney, Agent, or Firm*—R. J. Steinmeyer; F. L. Mehlhoff; William H. May

[57] ABSTRACT

A sealed bowl rotor having a transparent lid for easy visual checking of rotor contents. The lid has sealing means that automatically creates a seal which prevents the escape of liquid samples from within the rotor when the lid is placed on the rotor. The rotor design prevents the application of any possible hydraulic loading on the transparent lid. The installing/removing mechanism on the lid provides the capability for removal of the lid after the centrifugation run without disturbing the contents of the samples within the rotor.

5 Claims, 3 Drawing Figures

AEROSOL RESISTANT BOWL ROTOR

BACKGROUND OF THE INVENTION

The present invention is related to centrifuge rotors and, more particularly, is directed to a centrifuge bowl rotor with a transparent lid capable of being sealed to the rotor in such a manner that any internal liquid sample which is accidentally aerosolized within the rotor will be contained within the rotor.

In order to more fully understand the circumstances involved when a liquid becomes aerosolized attention is directed to the following discussion relating to the causes and characteristics of an aerosol especially with respect to a centrifuge rotor. An aerosol is any more or less stable dispersion of fine particles in a gas. The particle size distribution and the exact meaning of stable are not universally defined but are usually based on consideration of the immediate aerosol related application or investigation. For present purposes, particles in the size range of 15 $\mu$M and lower have sufficiently low settling rates to be of concern. Fine aqueous droplets in a low humidity environment will tend to form smaller or even fully dried solid particles which will have even lower settling rates. The particle size range of most immediate hazard to humans are particles of 2 $\mu$M to 8 $\mu$M, which penetrate and are retrained in the aveoli of the lungs on inhalation. It is also this size range and somewhat larger which can be expected to become rather thoroughly distributed throughout a laboratory within minutes or a few hours of an aerosol release. Both inhalation and surface contamination are of concern.

Any sort of liquid splashing or bubble breaking gives rise to aerosol formation. Due to the high centrifugal field in a centrifuge rotor the liquid released from a suddenly failed centrifuge tube literally crashes against the rotor wall. The closest familiar analogy might be the splashing of water at the base of a very high waterfall, where the mist formation is a matter of common observation. Liquid particles will to a considerable extent be sedimented in the centrifuge rotor so that given a sufficiently long run, all of the aerosol will be collected providing there was no way for it to escape from the rotor. However, it must be noted that in many applications runs are quite short, and broken tubes also lead to run termination by excessive vibration. It follows that it is desirable for the operator to have easy means for observing tube breakage so that the rotor will not be opened while there may still be aerosol in it, except inside a suitable biocontainment hood.

A classical means for generating aerosols is by feeding a liquid to a spinning disc or spray head. Clearly, a centrifuge leaking a liquid from a large diameter rotor running at high speed is a very good aerosol generator. The liquid is pulled from the rotor by its centrifugal weight in tread-like streams. A short distance from the rotor the streams become unstable, depending on surface tension, density and viscosity and break up into rather uniform size droplets. These droplets, which in the instance of most practical centrifuges, are quite large and always accompanied by a small trailing cloud of very small particles. It is these latter particles which are of great concern.

One of the more important concerns in clinical and research laboratories is the escape of any hazardous materials during experimentation. Quite often, it is necesary to place a container of hazardous biological material having dangerous viruses in a centrifuge rotor for a centrifugation run to separate particular strains of viruses. However, for the safety of the individuals in the laboratory, it is necessary to provide all possible safety precautions to prevent any accidental contact between the personnel in the laboratory and the dangerous virus or other biologically active material.

The containment of a liquid sample is normally assured when the sample is placed within a sealed centrifuge tube and placed within a rotor having a cover lid. But, in some instances, the centrifuge tube or sample holding container may have a defect which will result in rupture during high speed centrifugation, causing the leakage of the dangerous material into the rotor itself. Depending upon the design of the rotor, some of the liquid may be aerosolized and escape from the rotor if it is not properly sealed or otherwise contained.

In some cases where a lid is provided to close the rotor, the lid is typically made of a solid metal or other opaque material which does not permit the visual inspection of the contents of the rotor after centirfugation. Consequently, it is almost impossible for the operator to tell whether or not any of the centrifuge tubes or containers have been broken during the centrifugation run which would result in exposure of the operator to a possible hazardous biological material when the lid is removed from the rotor. It is extremely important that any sealing means between the lid and the rotor provides essentially complete sealing under both static and running conditions, so that there is complete containment of any hazardous material within the rotor.

One of the more important requirements of the lid of the rotor is that it be able to withstand any hydraulic forces that may be applied to it due to the leakage of a fluid sample within the rotor.

The hydraulic head that will be generated by a liquid in a centrifuge depends on the radial depth of the liquid and the average centrifugal field. If the liquid is rotating as a "solid" plug (forced vortex), then with respect to the rotor it generates a hydrostatic pressure; however, because it is moving with respect to ground, it is in reality a hydrodynamic pressure. Furthermore, especially under leaking sample tube conditions, the free liquid in the rotor may not rotate as a solid plug and instead may be, on average,tending to rotate faster or slower than the rotor. In the first instance, the hydraulic force will be higher and in the latter instance lower than the "solid" plug condition. Which condition may exist depends on the way the tubes are leaking. The hydraulic forces of a free liquid sample in a rotor can become quite substantial when operating at high speeds and, therefore, may be substantial enough to break the seal which may have been established between the rotor lid and the rotor. As a consequence, the escaping liquid sample from within the rotor may be thrown outward within the centrifuge, generating an aerosol in the process, and causing contamination of the centrifuge area.

SUMMARY OF THE INVENTION

The present invention is directed to a rotor lid for sealing engagement with a bowl type rotor in such a manner that any leakage of the liquid sample from a centrifuge tube is completely contained within the rotor and is prevented from escaping in either the form of an aerosol or in the form of a macroheterogeneous particle size spray of liquid outside of the rotor itself. The rotor lid is made of a transparent material, so that the operator can visually observe the internal contents of the rotor after the centrifugation run to determine whether or not any of the fluid sample containers have broken, resulting in the escape of the fluid sample within the rotor itself.

The rotor is designed in such a manner that the outer interior wall of the bowl rotor has an under cut shoulder or lip portion which is designed to receive possible hydraulic forces that may be exerted by any escaped fluid sample. Therefore, none of the hydraulic forces will be exerted upon the rotor lid which may be constructed of a somewhat flexible transparent material. The protection of the lid from these possible hydraulic forces is provided by having the seal at a radius that is less than the radius of the free liquid surface formed when the liquid volume of all the tubes is assumed to have been released into the rotor. The outer diameter of the lid is moved inward toward the central portion of the rotor, so that a lip portion at the upper end of the rotor is designed to receive the possible hydraulic forces.

It is also important with respect to the design of a rotor lid that it be capable of installation and removal with a minimum of disturbance to the contents of the rotor. The present invention utilizes a one-step retaining screw assembly to provide easy installation and removal of the lid upon completion of the centrifugation run without disturbance to the contents.

Also, it is extremely important in the design of the sealing arrangement that the rotor lid be insensitive to operator or user manipulation, so that its sealing capability is not directly related to how tight or accurately the operator places the lid on the rotor. In the present invention a piston type seal is utilized for not only the outer large diameter of the lid, but also the smaller interior diameter of the lid which mates with the central post in the rotor. Although it has been known in the prior art to use piston type seals to overcome the inherent operator sensitivity to facing type squeeze seals, the prior art has always utilized heavy metal covers with these types of seals. However, none have used the combination of a transparent flexible type of lid in conjunction with the piston type seals.

DETAILED DESCRIPTION OF THE INVENTION

Figure 1:
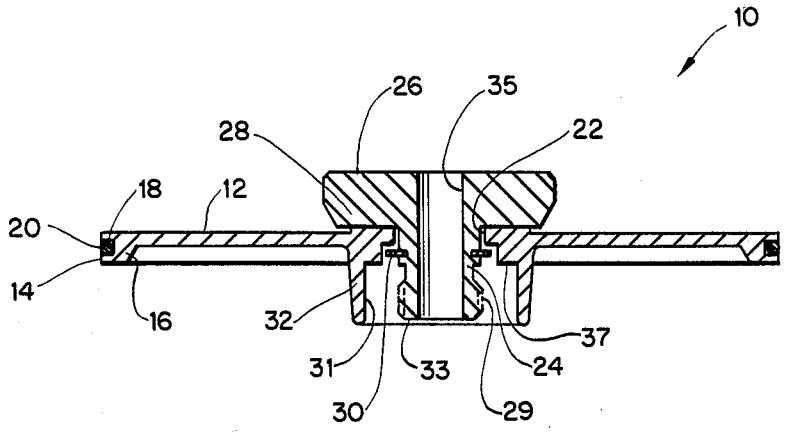
FIG. 1 is a sectional view of the lid of the rotor embodying the present invention.

The rotor lid 10 of the present invention is shown in FIG. 1 having a disc or cover portion 12. Adjacent to the outer circumferential edge 14 of the lid 12 is a thickened rim 16 which has a greater thickness than the cover portion 12. Recessed within this thickened rim 16 from the outer edge 14 is an annular groove 18. The annular groove 18 has a sealing member 20 which is preferably an O-ring.

Near the center of the cover 10 is an opening 22 designed to receive the shaft portion 24 of the lid handle 26. The gripping portion 28 of the handle 26 has a larger diameter than the opening 22 in the lid 12. Located on the shaft portion 24 on the opposite side of the lid 10 from the gripping portion 28 is a retaining washer 30 that is larger than the diameter of the central opening 22 in the lid, so that the handle 26 will always be retained within the opening 22. A plurality of threads 29 are located toward the lower end 33 of the shaft 24 for threaded engagement with the rotor as will be explained. The opening 35 in the handle 26 allows access to the connecting bolt for securing the rotor to the centrifuge drive spindle (not shown). Adjacent to the central opening 22 on the lid 12 is an integral cylindrical depending flange or skirt 32. The lid 12 is preferably made of a transparent plastic which allows observation into the rotor when the lid is in place.

Figure 2:
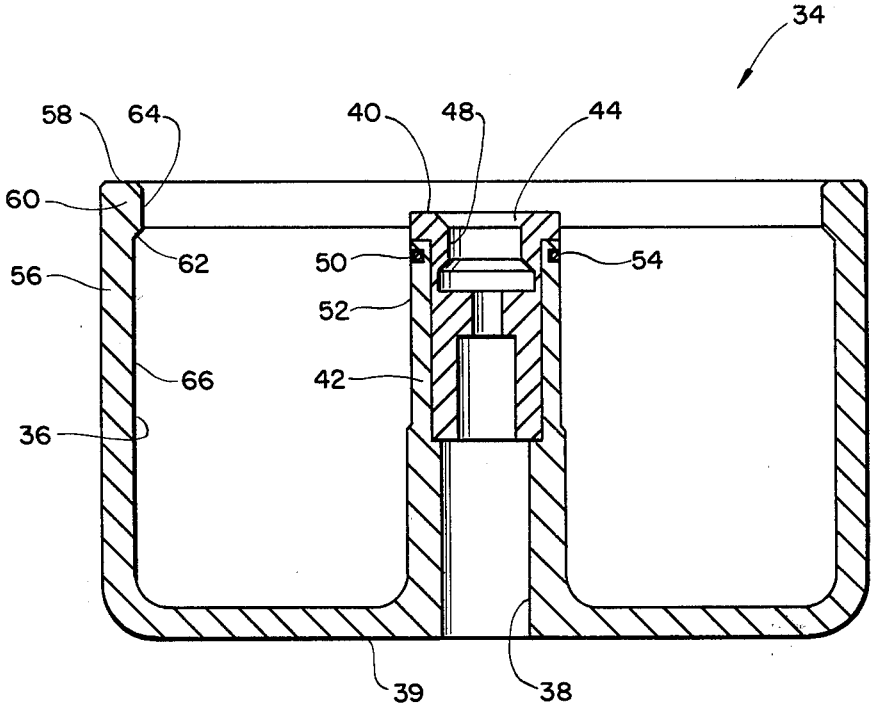
FIG. 2 is a sectional view of the rotor designed to receive the lid in FIG. 1.

The rotor 34 to which the lid in FIG. 1 is designed to attach is shown in FIG. 2. This rotor 34 is a bowl type rotor having a chamber 36 designed to receive sample holding members (not shown) carrying fluid samples to be subjected to centrifugation. There is a central recess 38 in the bottom 39 of the rotor which is designed to receive the spindle from the centrifuge for driving the rotor to the desired speed for the centrifugation operation. Located at the top 40 of the central post 42 in the rotor 34 is recess 44 designed to receive the shaft portion 24 of the lid handle 26 shown in FIG. 1. Located within the recess 44 of the central post 42 in FIG. 2 are threads 48 designed to engage with the threads 29 on shaft 24 in FIG. 1.

Located adjacent the top 40 of the central post 42 in FIG. 2 is an annular groove 50 recessed from the surface 52 of the central post 42. Positioned within this groove 50 is a sealing means 54 which is preferably an O-ring.

As shown in FIG. 2, the outer wall 56 of the rotor 34 has at its upper end 58 an enlarged or thickened portion 60. This enlarged portion 60 creates a lip or overhang 62, so that the inner surface 64 of the upper end 58 of the rotor is closer to the center of the rotor than the inner surface 66 of the wall 56.

Figure 3:
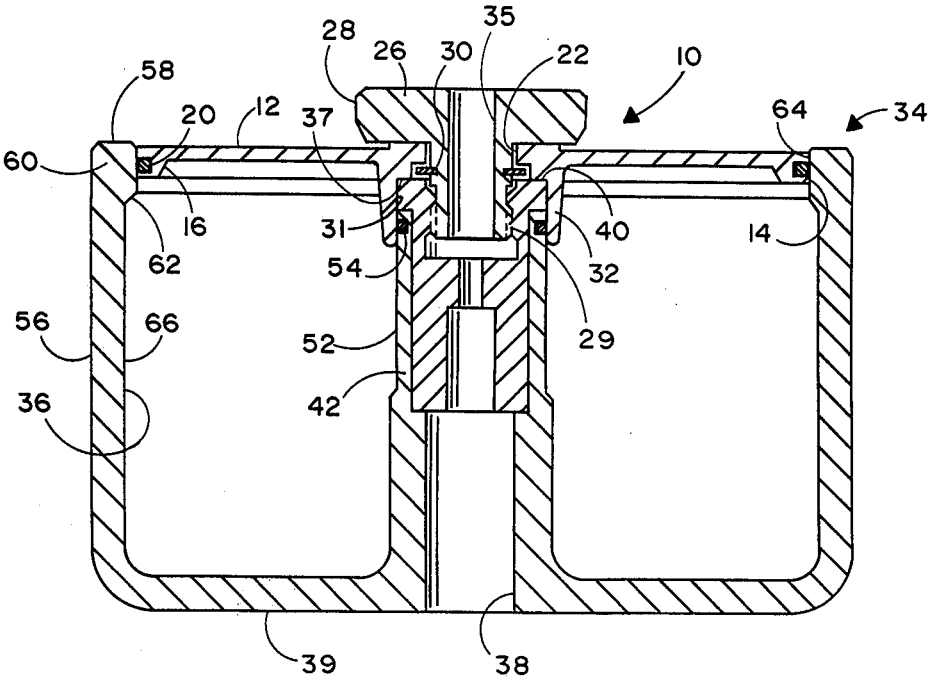
FIG. 3 is a sectional view showing the lid secured to the rotor embodying the present invention.

As shown in FIG. 3, the rotor lid 10 is positioned on the rotor 34 in such a manner that the outer edge 14 of the lid 12 mates with the inward facing surface 64 of the rotor 34. Further, the inner face 31 of the downward projecting flange 32 in the lid 12 mates with the surface 52 of the central post 42 in the rotor. The lid 10 is held secure to the rotor 34 by the threaded engagement of the shaft portion 24 of the handle 26 within the recess 44 of the central post 42 in the rotor. When the lid 12 is positioned on the rotor, the handle 26 is threaded into the recess 44. The handle 26 is turned until the shoulder 37 of the lid contacts the top surface 40 of the central post 42. This establishes the proper position of the lid on the rotor and the requisite tight sealing contact between the lid and the rotor. In any event, the seals are insensitive to the degree of tightening of the handle and will provide the requisite sealing even when the handle is not completely tight.

The sealing means or O-ring 20 located in the enlarged portion 16 of the lid 12 is in tight engagement with the inward facing surface 64 of the rotor, so that a completely tight seal is established. Further, the sealing means of the O-ring 54 is in tight engagement with the inner surface 31 of the depending flange 32 in the lid to create a tight and complete seal in the central portion of the lid. Therefore, if any centrifuge tubes should break during centrifugation, causing the escape of liquid within the rotor, the liquid will not escape the rotor itself because of the seals created by the sealing means 20 and the sealing means 54.

If any liquid should escape from the liquid sample holder within the rotor, it will accumulate along the outer internal surface of the rotor wall 56 because of centrifugally induced forces. The escaped liquid will not create a force on the lid, because the under cut or shoulder area 62 in the rotor wall 56 is designed to be large enough to contain the fluid. This is extremely important, since the lid is preferably made of a plastic material that is flexible, and therefore, if a significant force were placed on the lid from within the rotor, the lid would tend to possibly flex too far and break the seal between the inner surface 64 and the sealing means 20. The lid is made of transparent plastic to allow the operator to view the interior of the rotor after the centrifugation run to determine whether or not any fluid sample has escaped from its container within the rotor. This is important when dealing with possibly biologically hazardous samples with which the operator, for safety reasons, should not come in contact.

One of the more important advantages of using the piston type seal approach is the fact that the sealing is accomplished simply by having the operator grasp the holding means 26 and position the lid onto the rotor. Once the operator has placed the lid on the rotor and tightened the handle means 26 as outlined previously, the sealing numbers 20 and 54 are automatically set and the rotor is properly sealed to provide aerosol containment.

The handle 26 permits the desirable attribute of being able to remove the lid with little or no disturbance to the centrifugated samples which are located in the rotor 34.

The screw type handle 26 provides means for gently forcing the piston type sealing O-rings into and out of engagement with their mating cylindrical surfaces thereby minimizing any mechanical agitation of the centrifuged samples.

What is claimed is:

1. A centrifuge rotor comprising:

a body having an interior chamber, the upper end of said body having an opening to permit installation and removal of fluid sample containers;

a transparent lid with a cylindrical outer periphery;

means for connecting said lid to said body;

means for sealing said cylindrical outer periphery of said lid with said opening, said sealing means preventing the escape along said lid periphery of any aerosolized liquid sample from within said chamber;

a central post within said chamber;

a central depending cylindrical flange on said lid for receipt of said central post; and means for sealing said depending cylindrical flange with said post so that the escape along said central post of any aerosolized sample within said chamber is prevented.

2. A centrifuge rotor comprising:

a body having an interior chamber;

a central post within said chamber;

a transparent lid with a central depending cylindrical flange for receipt of said central post;

means for connecting said lid to said post; and means for sealing said depending cylindrical flange with said post so that the escape along said central post of any aerosolized sample within said chamber is prevented.

3. A centrifuge rotor as defined in claim 2, wherein said sealing means comprises a recess within one of said post and said flange and a sealing element located in said recess for engagement with the other of said post and said flange.

4. A centrifuge rotor comprising:

a rotor body forming an interior chamber, the upper end of said chamber having an opening to permit placement and removal of fluid sample holders;

a lid placed over said opening to completely enclose said chamber;

a central post within said chamber;

a central depending cylindrical flange on said lid for receipt of said central post;

means for sealing said depending cylindrical flange with said post;

means for connecting said lid to said body; and a lip portion around the opening of said body, said lip portion forming an upper shoulder area within said chamber adjacent said opening, so that any fluid sample escaping one of said holders during centrifugation and contacting the outer wall of said chamber will be retained under said shoulder area and will not contact said lid.

5. A centrifuge rotor comprising:

a rotor body having a chamber for receipt of fluid samples, said rotor body having an upper opening;

a central post within said chamber;

a transparent lid removably positioned over said opening to enclose said chamber;

a generally cylindrical holding member connected to said lid and having a stud member for threadable engagement with said central post, rotation of said holding member in one direction securing said lid to said post, rotating of said holding member in a direction opposite said one direction disconnecting said lid from said post;

means for sealing said lid to said body to contain an aerosolized liquid sample within said chamber during centrifugation; and means on said lid for automatically setting said means when said lid is secured to said rotor body.

* * * * *